United States Patent [19]

Eheim et al.

[11] Patent Number: 4,534,332

[45] Date of Patent: Aug. 13, 1985

[54] FUEL INJECTION PUMP FOR INTERNAL COMBUSTION ENGINES WITH AN ADJUSTMENT OF THE INSTANT OF INJECTION

[75] Inventors: Franz Eheim; Helmut Laufer, both of Stuttgart, Fed. Rep. of Germany

[73] Assignee: Robert Bosch GmbH, Stuttgart, Fed. Rep. of Germany

[21] Appl. No.: 415,944

[22] Filed: Sep. 8, 1982

[30] Foreign Application Priority Data

Feb. 3, 1982 [DE] Fed. Rep. of Germany ..... 3203583

[51] Int. Cl.[3] ..... F02M 59/20

[52] U.S. Cl. ..... 123/502; 123/458

[58] Field of Search ..... 123/502, 458, 359, 357, 123/358

[56] References Cited

U.S. PATENT DOCUMENTS

| | | | |
|---|---|---|---|
| 3,273,090 | 6/1983 | Höfer | 123/502 |
| 4,312,316 | 11/1982 | Seilly | 123/499 |
| 4,373,492 | 2/1983 | Konrath | 123/502 |
| 4,395,987 | 8/1983 | Kobayashi | 123/458 |

*Primary Examiner*—Carl Stuart Miller

*Attorney, Agent, or Firm*—Edwin E. Greigg

[57] ABSTRACT

A fuel injection pump having a device for adjusting the injection timing having a work chamber defined by an adjusting piston and communicating via a throttle bore with a pressure source from which the pressure to adjust the adjusting piston is drawn. In order to modify the pressure in the work chamber, the work chamber can be made to communicate via a pressure limiting valve with the relief side of the pump. The control force of the pressure limiting valve is adjustable by means of a stepping motor. An influence on the pressure controlling the adjusting piston is thereby obtained which is restricted to the work chamber.

6 Claims, 5 Drawing Figures

FUEL INJECTION PUMP FOR INTERNAL COMBUSTION ENGINES WITH AN ADJUSTMENT OF THE INSTANT OF INJECTION

BACKGROUND OF THE INVENTION

The invention is directed to a fuel injection pump having an adjusting piston subject to a fluid-pressurized restoring force varied in accordance with engine operating parameters. In a typical fuel injection pump of this type, such as is known from German Offenlegungsschrift No. 26 48 043.3, the adjusting piston which serves to adjust the instant of injection is subjected to the rpm-dependent pressure which prevails in the suction chamber of the fuel injection pump. The rpm-dependent pressure is generated with the aid of a pressure control valve. In order to adjust the instant of injection toward an "early" setting during starting and engine warmup, the hydraulic pressure is increased by reducing the quantity of fuel flowing out of the suction chamber. To accomplish this result, one embodiment of fuel injection pump is provided with a supplementary outlet passage extending from the suction chamber, which outlet is closed during starting and warmup.

OBJECT AND SUMMARY OF THE INVENTION

It is a principal object of the invention to provide a fuel injection pump having the advantage over the prior art that the pressure acting upon the adjusting piston of the injection adjusting device can be influenced at other times than merely during cold starting and engine warmup. With preferred embodiment according to the invention, the required instant of injection can be established in all operating ranges of the engine by modifying the pressure in the work chamber of the adjusting piston.

It is another object of the invention to uncouple the work chamber from the pressure source or from the suction chamber of the fuel injection pump by means of a throttle, so that only the pressure prevailing in the work chamber of the adjusting piston is modified. In this manner the pressure in the suction chamber of the fuel injection pump may remain dependent only on the rpm, for example.

It is still another object of the invention to adapt the instant of injection so that no retroactive effect on the quantity control of the fuel injection pump can occur via the pressure in the suction chamber which has a quite substantial effect on the fill level of the pump work chamber.

It is yet another object of the invention that the pressure in the work chamber be varied quickly, without effecting a great change in the volume of the fuel flowing out of the compression side of the supply pump.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
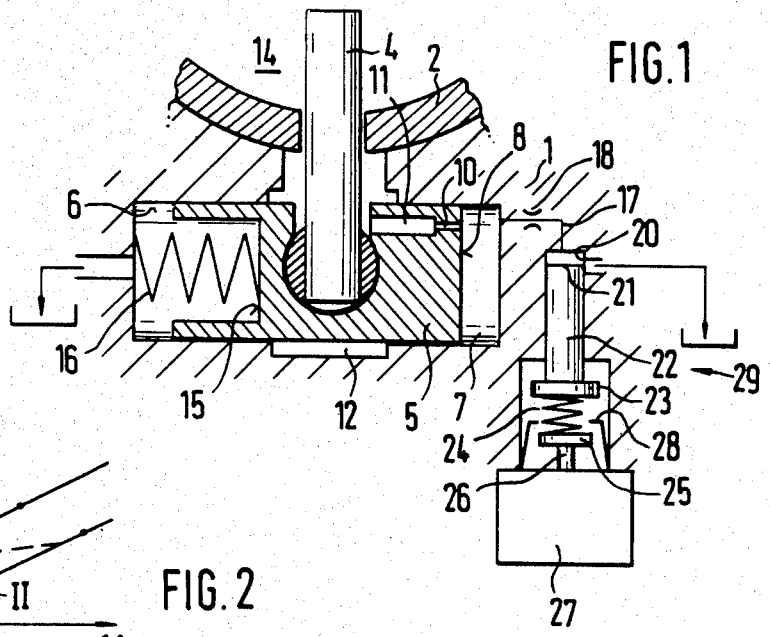
FIG. 1 is a partial cross-sectional view of a first exemplary embodiment of the invention showing a control piston which is displaceable by the pressure in the work chamber counter to spring force for controlling an outlet passage.

FIG. 1 shows a detail of a fuel injection pump containing the adjusting device for the instant of injection. A cam drive 2 is rotatably supported in the housing 1 of the fuel injection pump; it controls the actuation of the pump injection piston or pistons and the instant of injection depends upon its rotational position. This cam drive may, for example, be a cam ring in the case of a radial-piston distributor injection pump or a roller ring in the case of a reciprocating-piston distributor injection pump. A pin 4 which is movably connected to an adjusting piston 5 engages the cam drive 2. The adjusting piston 5 is disposed in a tightly displaceable manner within a closed cylinder 6. With a first end face 8, the adjusting piston 5 defines a work chamber 7 in the cylinder 6, and a bore 11 containing a throttle 10 originates at the end face 8 and discharges in constant open communication with a recess 12 in the jacket face of the cylinder. The recess 12 is furthermore in continuous communication with a pressure source, the pressure of which is varied in accordance with the rpm with the aid of a pressure control valve, not further shown. This pressure source may, for example, be the suction chamber 14 of the fuel injection pump.

Engaging a second end face 15 of the adjusting piston 5 is a spring 16, which is supported on one end of the cylinder 6 and tends to displace the adjusting piston counter to the pressure prevailing in the work chamber 7. The work chamber 7 communicates with a relief chamber via a relief line 17, in which a damping throttle 18 is disposed.

The discharge cross section 20 downstream of the damping throttle 18 is controlled by means of the end portion 21 of a control piston 22, the end face of which is subjected to the pressure in the work chamber 7; a compression spring 24 is fastened between the other end face 23 of the control piston 22 and an adjustable support point 25. The support point 25 is firmly connected via an actuation member 26 with a stepping motor 27 and is displaceable as far as a fixed stop 28 by the stepping motor. The stepping motor is controlled by a control device, not otherwise shown, which processes operating engine parameters of importance in adjusting the instant of injection. When the fuel injection pump is operating, the pressure prevailing in the pressure chamber 13 is at first established in the work chamber 7. However, this pressure can be modified by uncoupling the pressure chamber and the work chamber via the throttle 10, with the aid of the pressure limiting valve 29 comprising the control piston 22 and the compression spring 24.

Figure 2:
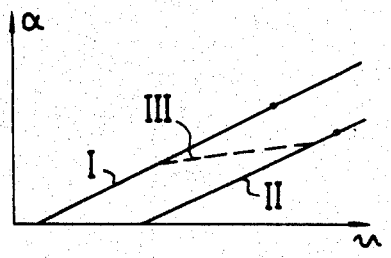
FIG. 2 is a diagram showing the injection time settings attainable with the exemplary embodiment of FIG. 1, plotted over the rpm.

In FIG. 2, two characteristic curves for the injection timing adjustment $\alpha$ are plotted over the rpm. Curve I represents the injection timing adjustment when the relief line is closed, and curve II represents the adjustment of injection timing when the relief line is open. If the support point 25 of the spring 24 is not varied beyond a predetermined point during operation, then an injectionn adjustment as represented by curve III takes place, curve III extending from some point on curve I toward a point on curve II taking a substantially less steep slope than either. In this case, the pressure in the work chamber 7 increases only slightly as the rpm increases. By means of the circuit (not shown) for triggering the stepping motor 27, a course of injection timing adjustment over the rpm can then be established in any arbitrary manner between the two curves I and II. Preferably the rpm as well is taken into consideration in adjusting the compression spring 24.

Figure 3:
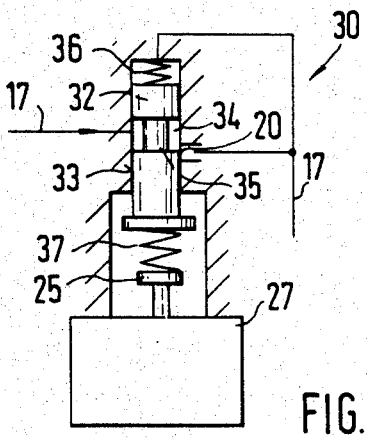
FIG. 3 is a detail cross-sectional view of a second exemplary embodiment of a control slide for controlling the outlet passage.

Instead of the pressure limiting valve 29, a control valve 30 as shown in FIG. 3 can also be inserted into the relief line 17. This valve comprises a control slide 32, which is tightly but displaceably disposed within a cylinder 33. The relief line 17 discharges in the vicinity of an annular groove 34 in the jacket face of the control slide 32, the relief line 17 communicating continuously with this annular groove 34. The discharge cross section 20 is controlled by one limiting edge of the annular groove 34, in accordance with the position of the control slide 32.

The control slide 32 is disposed between a first compression spring 36 and a second compression spring 37; the first compression spring 36 is supported in a fixed manner, while the second compression spring 37 is supported on a support point 25 which is adjustable by means of a stepping motor 27.

This embodiment has the advantage over that shown in FIG. 1 that the control slide is balanced in pressure, and if the setting of the stepping motor 27 remains the same, the discharge cross section 20 does not vary with increasing pressure in the work chamber 7. Thus in triggering the stepping motor 27 the rpm does not need to be taken into consideration, presuming that a substantially rpm-dependent adjustment of the instant of injection is to be maintained. In this embodiment, only the pressure acting upon the adjusting piston is adapted, by means of the control slide, to requirements at various operating points. The suspension of the control slide between two springs has the advantage that the adjustment distance traveled by the support point 25 can be longer than the corresponding adjustment travel of the control slide, which of course needs merely to execute quite short strokes in order to vary the discharge cross section 20.

Figure 4:
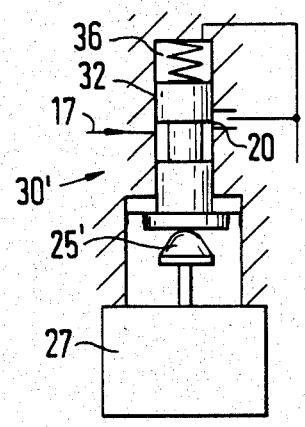
FIG. 4 is a detail cross-sectional view of a third exemplary embodiment of a control slide for controlling the outlet passage.

FIG. 4 shows a simplified variant of the exemplary embodiment of FIG. 3. The control valve 30' in FIG. 4 again has a control slide 32, which controls the outflow cross section 20 of the relief line 17. However, the slide 32 is acted upon on only one end by a first compression spring 36, which is supported in a stationary manner. The other end is engaged directly by the support point 25', which is adjustable, as in the previous embodiment, by means of the stepping motor 27. However, in this case the travel of the support point or the adjustment range of the stepping motor has to be adapted to the slight stroke height required for controlling the discharge cross section 20.

The exemplary embodiments of FIGS. 3 and 4 have the advantage that in controlling the pressure in the work chamber 7, a recoil transmitted from the cam drive onto the adjusting piston 5 can have no adverse effect. For this reason, the damping throttle 18 provided in the relief line in the exemplary embodiment of FIG. 1 is not necessary and thus omitted here.

Figure 5:
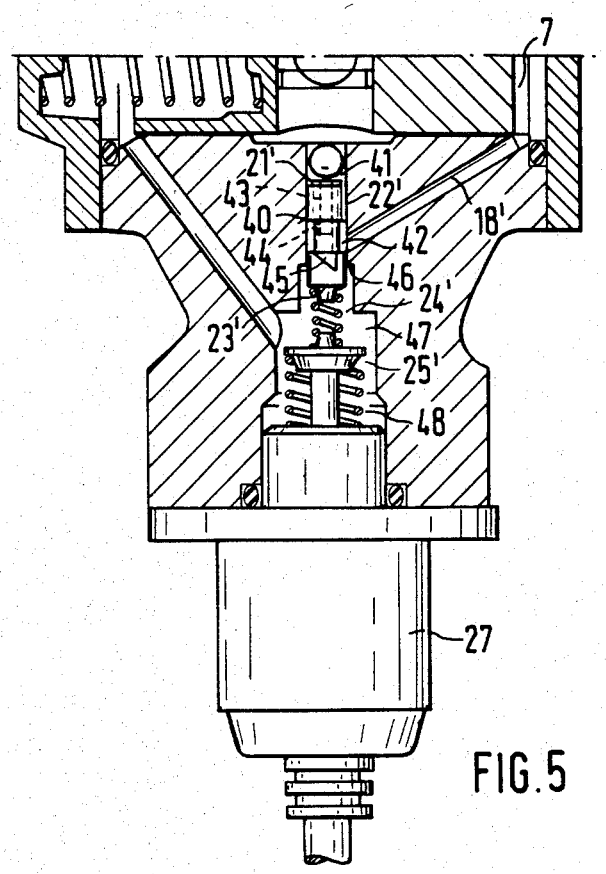
FIG. 5 is a cross-sectional view of a fourth exemplary embodiment of a control slide as a variant of the example shown in FIG. 1.

FIG. 5 shows a fourth embodiment of the control slide, as a modification of the exemplary embodiment of FIG. 1. In this latter case, a control slide 22' that is, a further embodiment of the control piston 22 shown in FIG. 1 is disposed in a cylinder 40 and a first end face 21' defines a pressure chamber 41 in the cylinder. This pressure chamber 41 communicates continuously, via a bore 43 in the control slide, with an annular groove 42 on the control slide, and a damping throttle 44 may be disposed in the bore 43. The annular groove 42 furthermore communicates continuously, via the relief line 18' discharging into the cylinder 40, with the work chamber 7. Beginning at the annular groove, a recess 45 is disposed in the jacket face of the control slide directed toward the second end face 23' of the control slide, and the cross section of the recess 45 decreases toward the second end face 23'. The recess 45 cooperates with a control edge 46, which is formed at the transition from the cylinder 40 to an adjacent relief chamber 47 of larger diameter. The variable discharge cross section is formed between the recess 45 and the control edge 46.

The support point 25' which is adjustable by the stepping motor 27 protrudes into the relief chamber 47 coaxially with the control slide, and the spring 24' is disposed between the support point 25' and the second end face 23'. The support point 25' is furthermore displaced, and the spring 24' unstressed when the stepping motor operates to draw the support point 25' downwardly counter to the force of a restoring spring 48.

In this fourth exemplary embodiment, as in FIG. 1, the control slide is displaced counter to the spring 24' by the pressure prevailing in the work chamber 7. The embodiment of the recess 45 permits the travel of the control slide to be longer than is possible in FIG. 1, although the variation in the discharge cross section remains the same. It is furthermore possible, by adapting the cross sectional course of the recess, to attain the desired pressure-variation characteristic or to compensate for undesirable characteristics of the restoring spring or of the adjustment drive.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines provided with means for adjusting injection timing, said means comprising an adjusting piston disposed in a cylinder, a first end face of said adjusting piston defining with said cylinder a work chamber, said work chamber being pressurized by a fluid communicated from a pressure source, said pressurized fluid serving as a restoring force to said adjusting piston, said pressure source further being connected to a first pressure control device, and said pressure control device serving to vary the pressure applied to said fluid in accordance with at least one engine operating parameter, characterized in that a throttle cross section is disposed between said work chamber and said pressure source with constant communication therebetween, and said work chamber is provided with a relief line having a discharge cross section variable in accordance with at least one further other engine operating parameter, said discharge cross section being controlled by a control piston displaceable in response to the pressure in said work chamber counter to a spring, said spring being further retained on a support point displaced by an adjusting drive means in accordance with said at least one further other engine operating parameter, said control piston being disposed in a cylinder and including a first end serving to define a pressure chamber and a second end face acted upon by a spring, said pressure chamber being arranged to communicate via a bore with said relief line upstream of said discharge cross section, said control piston further including a control edge for controlling said discharge cross section and being provided with an annular groove and a recess connected therewith, said recess having a cross section and a longitudinal extent, said cross section varying over said longitudinal extent, and said recess cooperating with a control edge of said cylinder to form said discharge cross section.

2. A fuel injection pump as defined by claim 1, further characterized in that the support point is adjustable between two end stops.

3. A fuel injection pump as defined by claim 1, further characterized in that a damping throttle is disposed in the relief line upstream of the discharge cross section.

4. A fuel injection pump as defined by claim 1, further characterized in that a damping throttle is disposed in said bore.

5. A fuel injection pump as defined by claims 1 or 6, further characterized in that the adjusting drive means is a stepping motor.

6. A fuel injection pump for internal combustion engines provided with means for adjusting injection timing, said means comprising an adjusting piston disposed in a cylinder, a first end face of said adjusting piston defining with said cylinder a work chamber, said work chamber being pressurized by a fluid communicated from a pressure source, said pressurized fluid serving as a restoring force to said adjusting piston, said pressure source further being connected to a first pressure control device, and said pressure control device serving to vary the pressure applied to said fluid in accordance with at least one engine operating parameter, characterized in that a throttle cross section is disposed between said work chamber and said pressure source with constant communication therebetween, and said work chamber is provided with a relief line having a discharge cross section variable in accordance with said at least one engine operating parameter, said discharge cross section being varied by means of a pressure-balanced control slide, said control slide being displaced by an adjusting drive means in accordance with said at least one further other engine operating parameter counter to a restoring spring force and including an annular groove having a limiting edge for controlling said discharge cross section, said control slide further including first and second end faces stressed by first and second springs, said first spring being supported in a stationary manner and said second spring being supported on a support point adjustable by said adjusting drive means.

* * * * *